US006547160B1

(12) United States Patent
Huang

(10) Patent No.: US 6,547,160 B1
(45) Date of Patent: Apr. 15, 2003

(54) SPRAY GUN WITH A STABILIZING STRUCTURE OF AIR OUTPUT

(76) Inventor: Tiao-Hsiang Huang, No. 190, Chung Cheng Rd., Shin Chuang City, Taipei Hsien (TW)

( * ) Notice: Subject to any disclaimer, the term of this patent is extended or adjusted under 35 U.S.C. 154(b) by 0 days.

(21) Appl. No.: 10/291,437

(22) Filed: Nov. 12, 2002

(51) Int. Cl.[7] ..... B05B 1/28

(52) U.S. Cl. ..... 239/290; 239/291; 239/295; 239/296; 239/298; 239/300

(58) Field of Search ..... 239/290, 291, 239/294, 295, 296, 298, 300

(56) References Cited

U.S. PATENT DOCUMENTS 2,146,416 A * 2/1939 Bramsen et al. ..... 239/300
4,392,617 A * 7/1983 Bakos et al. ..... 239/290
5,344,078 A * 9/1994 Fritz et al. ..... 239/296
5,799,875 A * 9/1998 Weinstein et al. ..... 239/296
6,085,996 A * 7/2000 Culbertson et al. ..... 239/290
6,471,144 B1 * 10/2002 Huang ..... 239/296

* cited by examiner

*Primary Examiner*—Robin O. Evans
(74) *Attorney, Agent, or Firm*—Rosenberg, Klein & Lee

(57) ABSTRACT

A spray gun with a stabilizing structure of air output comprises a circular recess on an inner edge at the front end of the spray gun, the circular recess is connected to an air outlet of the spray gun, there is a gap formed between the inner edge of the spray gun and a spray tube, the gap is to store air from the circular recess and transforms to an air chamber formed between a circular trough and a collar so as to spray air out evenly.

1 Claim, 5 Drawing Sheets

SPRAY GUN WITH A STABILIZING STRUCTURE OF AIR OUTPUT

FIELD OF THE INVENTION

This invention relates to a spray gun, more particular to a spray gun with a stabilizer structure to control air outlet evenly.

BACKGROUND OF THE INVENTION

A conventional spray gun, as shown in FIGS. 4 and 5, comprises a spray head B threaded to the front end of a pray gun A. The spray head B is coupled with a nut C. The spray gun A comprises a spray tube A1 at front end with a circular recess A11 on its outer surface, three air outlets A12 are formed between the spray tube A1 and the circular recess A11, and an air outlet A2 is formed on the outer edge of the circular recess A11. The spray head B comprises a pair of air outlet B1 corresponding to and interconnecting with each other by a passage B2. The center portion of the spray head B has a spray hole B3. The spray head B also comprises an inner ring B4 and an outer ring B5 at inside and corresponding to the passages B2. The outer ring B5 has a sealing ring B6 sleeved thereon. The inner ring B4 engages with the circular recess A11 of the spray tube A1. An air chamber B7 is formed between the three air outlets A12 of the circular recess A11 and the spray hole B3 of the spray head B. Another air chamber B8 is formed between the air outlet A2 at the front end of the spray gun A and the passages B2 of the spray head B. This design allows air to output evenly.

However, this design has some shortcomings, such as the air outlet A2 is formed integral with the spray gun A, which aligns directly to a circular trough formed between the inner ring B4 and the outer ring B5. When high pressure air is applied, a turbulence is formed and the air outputs unevenly.

The other shortcoming is that the sealing ring B6 is hard to be taken apart from the outer ring B5, further a gap exists on the connection area between the spray head and the spray tube, which makes the spraying uneven as well.

SUMMARY OF THE INVENTION

It is the primary object of the present invention to provide a spray gun with a spray gun with a stabilizing structure of air output, which has an even output air.

It is another object of the present invention to provide a spray gun with a stabilizing structure of air output, which is easy to operate.

It is a further object of the present invention to provide a spray gun with a stabilizing structure of air output, which structure is solid and lasts longer.

DETAILED DESCRIPTION OF THE PREFERRED EMBODIMENT

Figure 1:
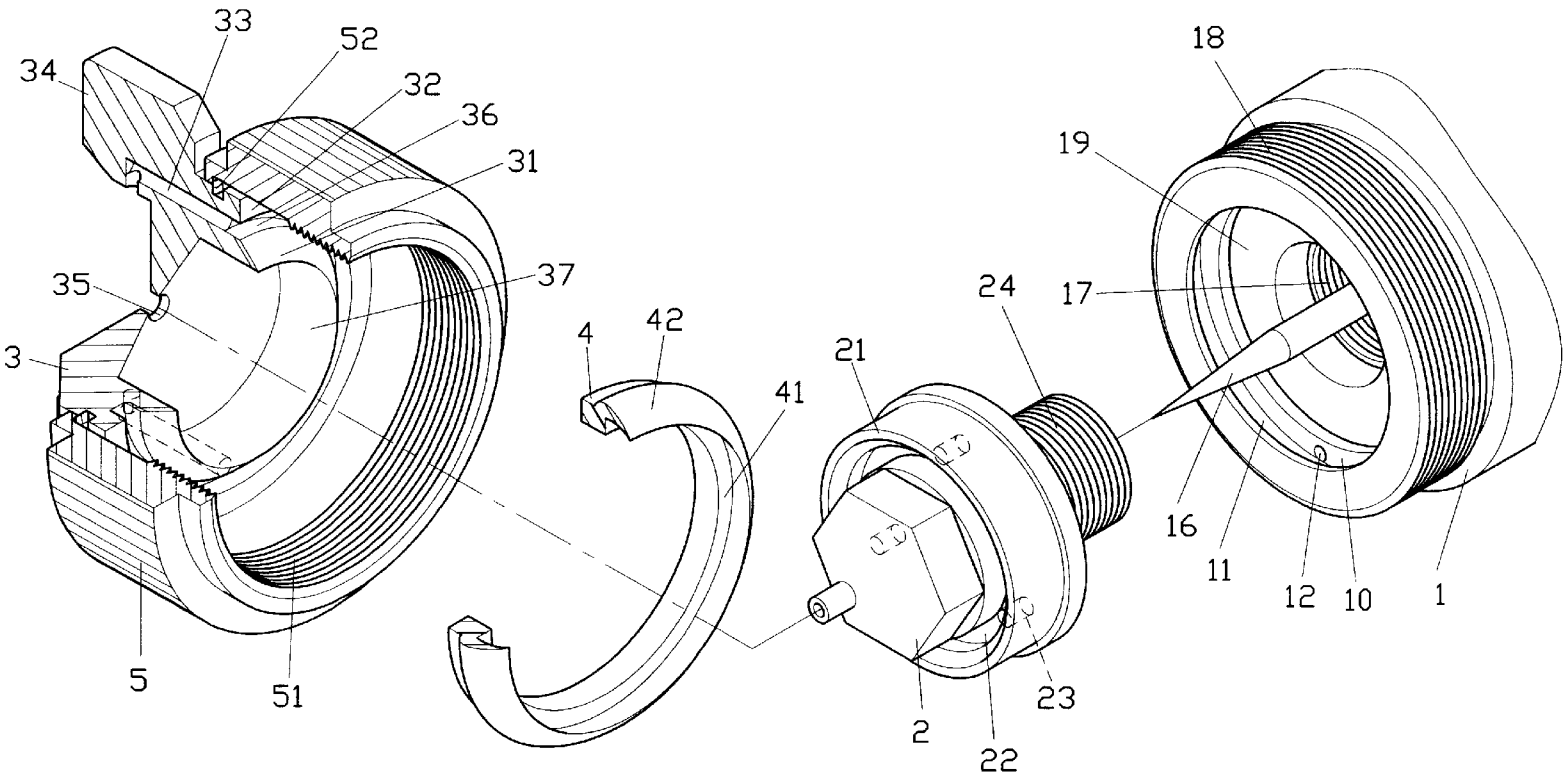
FIG. 1 is an exploded view of the present invention.

A spray gun 1 of the present invention, as shown in FIG. 1, comprises a dent 10 to receive a spray tube 2 therein, with a circular recess 11 on the inner edge thereof and an air output 12 on the circular recess 11. The inner hollow portion of the spray gun 1 has a needle valve 16 with female threads 17 therein. The spray gun 1 further comprises male threads 18 at it front end and a washer 19 therein.

The spray tube 2 has a portion to be inserted into the dent 10 of the spray gun 1, and the other portion exposed outwardly with a circular ring 21 thereat. The front end of the spray tube 2 has a circular trough 22 between the spray tube 2 and the circular ring 21 with a plurality of holes 23 thereon. The outer surface of the rear end of the spray tube 2 is formed with male threads 24. The spray tube 2 further comprises a hole 26 at inside thereof.

A spray head 3 comprises an inner ring 31 and an outer ring 32 inwardly, a spray hole 35 at the center, and a circular recess 36 between the inner ring 31 and the outer ring 32. The circular recess 36 comprises a pair of air passages 33 interconnected with an outlet section 34.

A collar 4 is made of plastic material with a circular surface 41 inwardly and a slanting surface 42 outwardly.

A nut 5 has female threads 51 inwardly and a washer 52 at the front end thereof.

Figure 2:
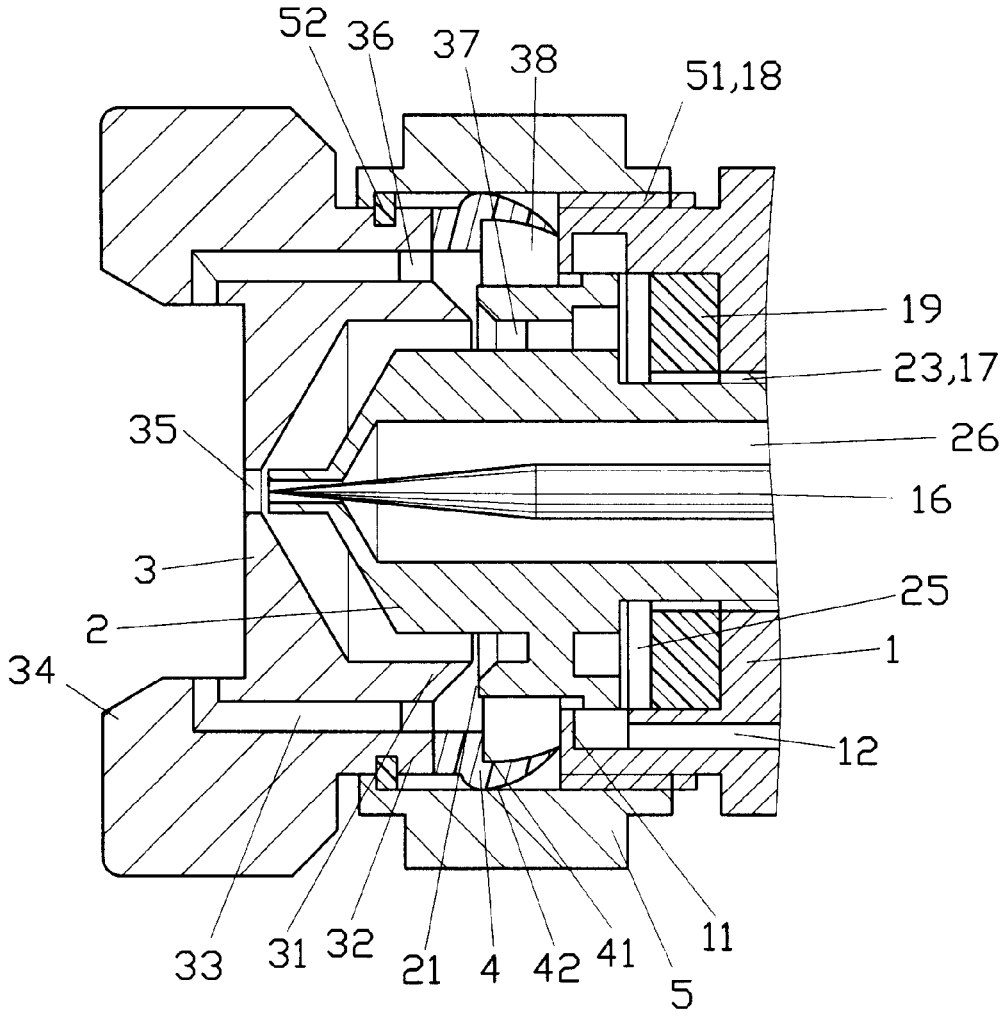
FIG. 2 is a side cross-sectional view of the present invention.

To assemble the present invention, as shown in FIG. 2, the female threads 24 of the spray tube 2 thread with the male threads 17 of the spray gun 1 so that the spray tube 2 is secured in the dent 10 of the spray gun 1, and a circular gap 25 is formed between the spray tube 2 and the spray gun 1. The circular gap 25 is interconnected to the circular recess 11 of the spray gun 1. The collar 4 is placed between the spray head 3 and the spray tube 2 at front end of the spray gun 1. The nut 5 engaged with the washer 52 is coupled to the spray gun 1 with the female threads 51 threaded onto the male threads 18 of the spray gun 1. This forces the outer ring 32 of the spray head 3 to engage and seal with one end of the collar 4, and the slanting surface 42 of the collar 4 is engaged with the front end of the spray gun 1. The inner ring 31 of the spray head 3 is engaged with the circular ring 21 of the spray tube 2, thus a first chamber 37 is formed between the inner ring 31 of the spray head 3 and the circular ring 21 of the spray tube 2. The first chamber 37 is interconnected with the spray hole 35 of the spray head 3 to facilitate spraying effort.

A second chamber 38 is formed between the outer ring 32 of the spray head 3 and the collar 4 at the front end of the spray gun 1. When the spray gun 1 starts to send high pressure air which goes through the air output 12 of the spray gun 1 and enters into the circular recess 11 and then through the circular gap 25 to the circular surface 41 of the collar 4 and the circular recess 36 between the inner ring 31 and the outer ring 32 to form a stable air pressure region, and then spreads out through the two air passages 33 to the air outlet section 34. This design provides a stable even air out through the two air passages 33 and outwardly from the spray hole 35 of the spray head 3.

Figure 3:
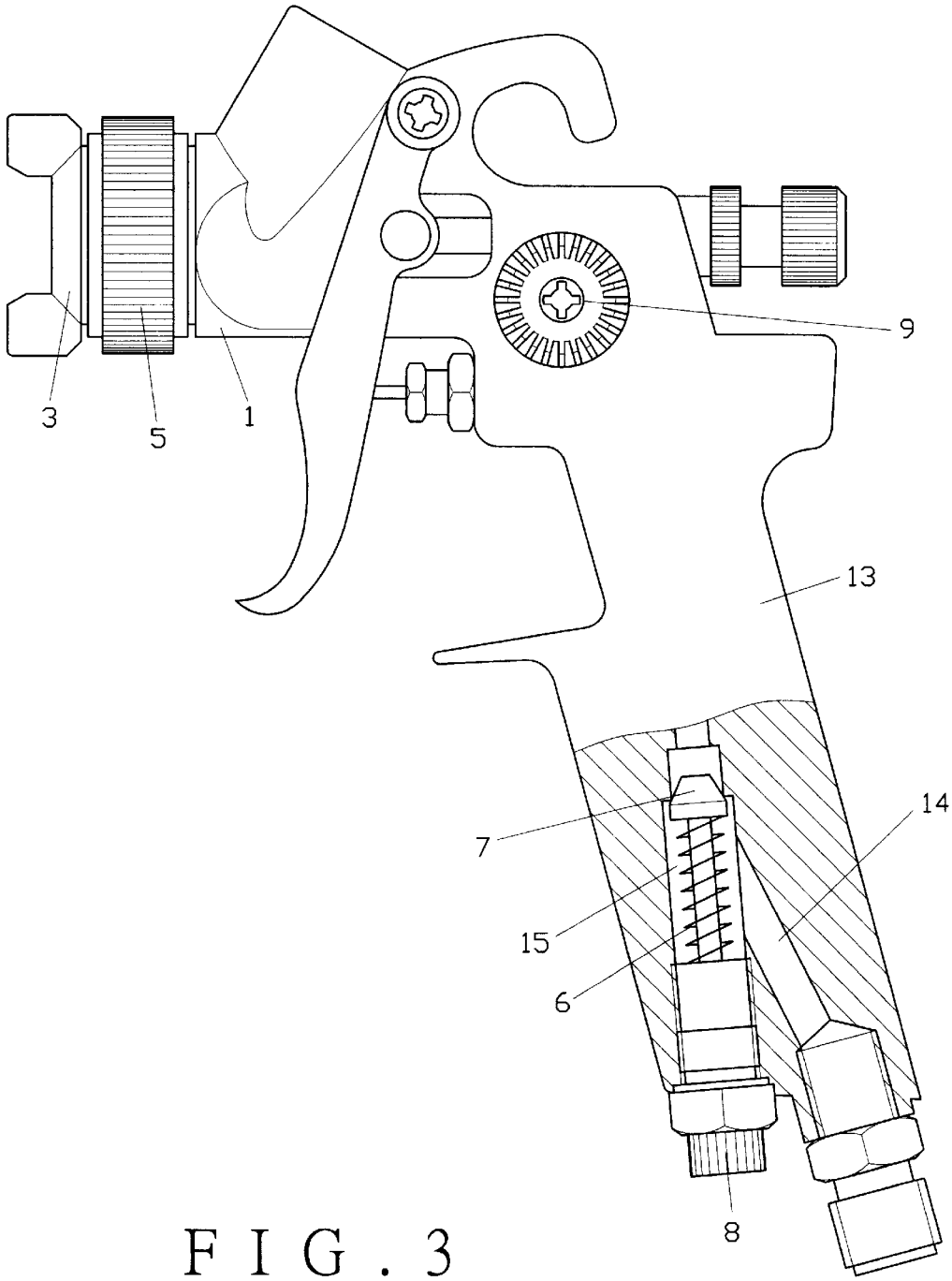
FIG. 3 is a side view of the present invention.
Figure 4:
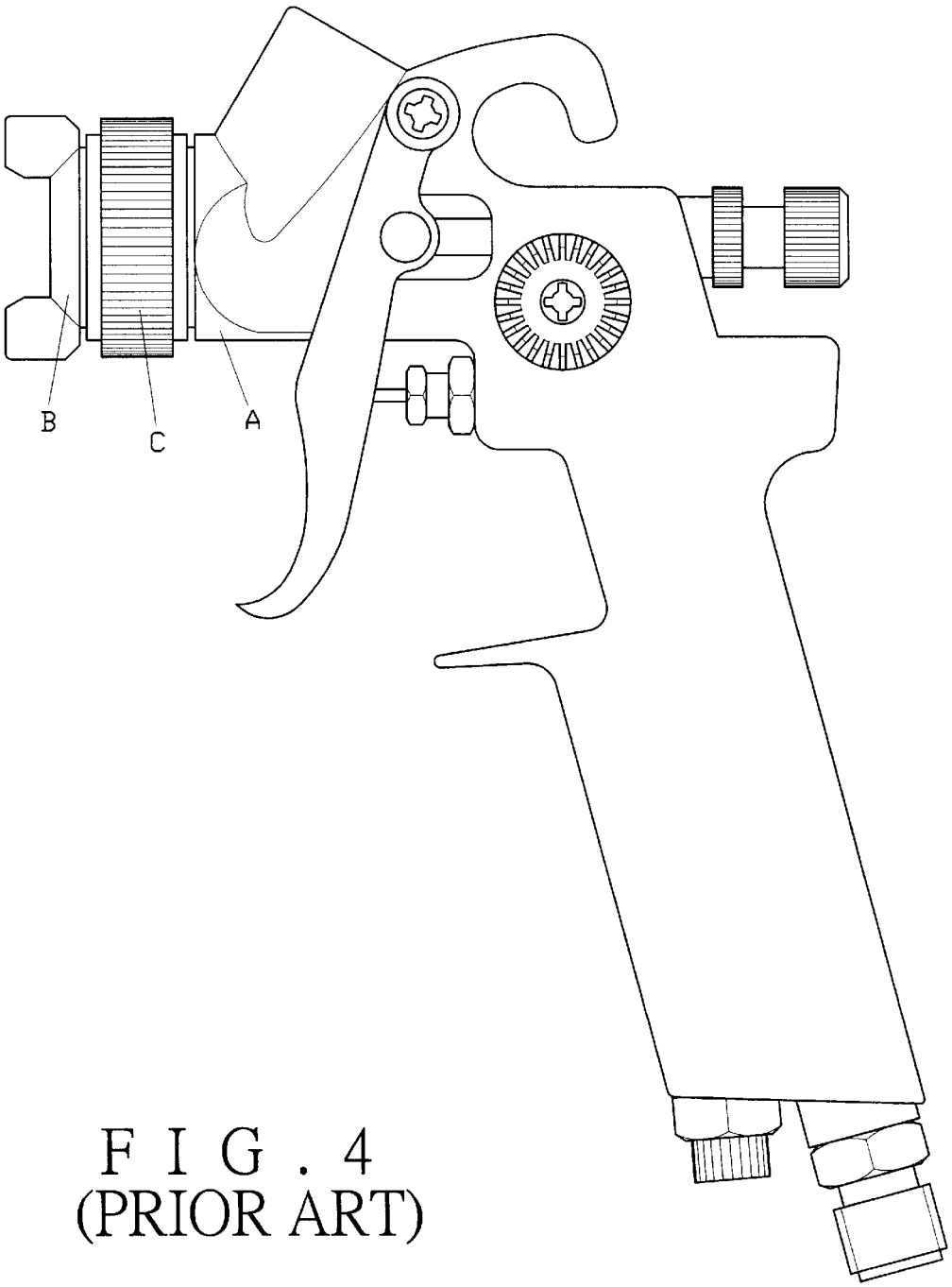
FIG. 4 (PRIOR ART)
FIG. 4 is a side view of a prior art of a spray gun.
Figure 5:
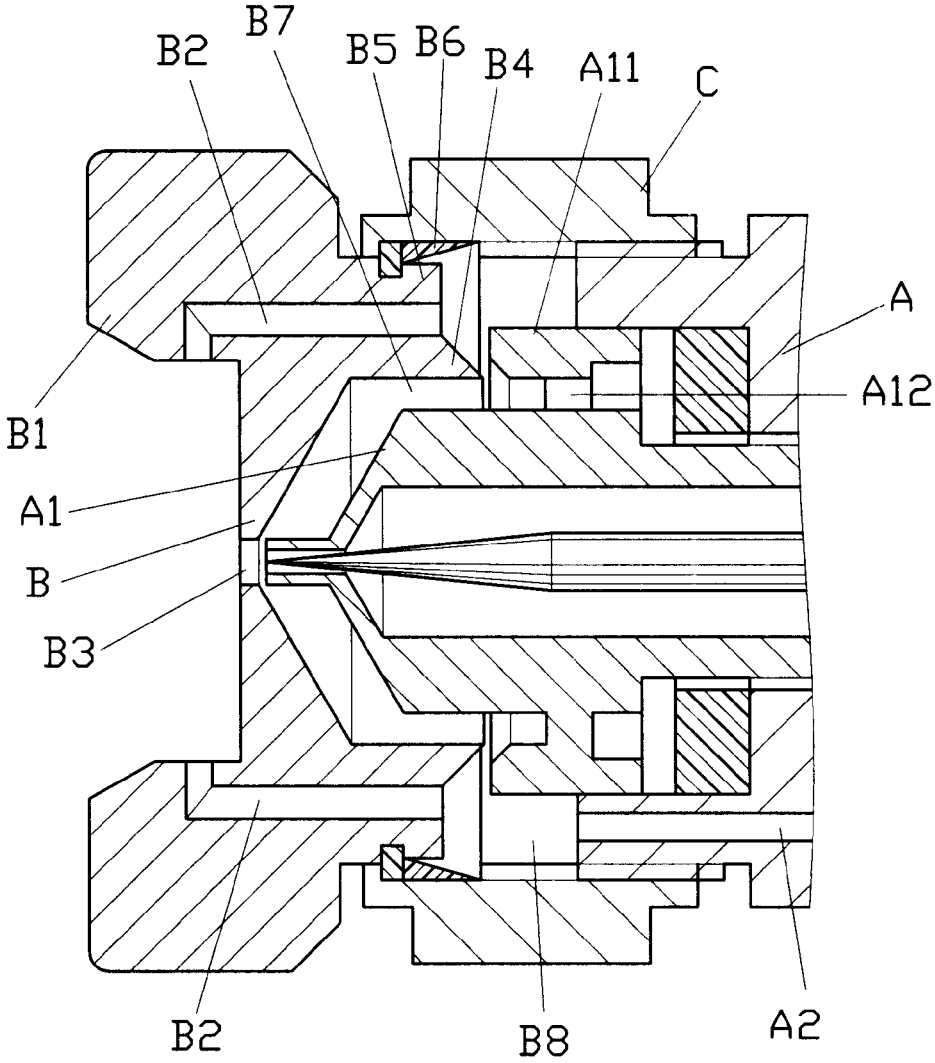
FIG. 5 (PRIOR ART)
FIG. 5 is a side cross-sectional view of FIG. 4.

FIG. 3 shows another embodiment, which is formed a passage 15 in the handle 13 next to a high pressure air passage 14. The passage 15 has an adjusting member 7 with a spring 6. One end of the adjusting member 7 has an adjustable knob 8 extending outwardly from the handle 13, which is able to adjust the adjusting member 7 so as to make a first adjustment of the high pressure air input, while an original knob 9 is functioned as a second and a micro adjustment device.

I claim:

1. A spray gun with a stabilizing structure of air output comprising a spray gun, a spray tube, a spray head and a collar, wherein said spray gun comprising a dent area at front portion thereof to receive a portion of said spray tube therein, said dent area comprising a circular recess having an air outlet therein, said spray gun having a hollow center with a needle valve and female threads therein, said spray gun further comprising a washer therein and male threads on outer surface;

said spray tube comprising a ring around outer edge, a circular trough with a plurality of holes being formed between said spray tube and said ring, said spray tube further comprising male threads at an outer surface of a rear section thereon;

said spray head comprising an inner ring and an outer ring inwardly, a circular recess between said inner ring and said outer ring, said circular recess further comprising a pair of air passages interconnected to an air outlet section, a spray hole being formed at center portion of said spray head;

said collar comprising a circular surface inwardly and a slanting surface formed outwardly thereof;

a nut comprising female threads therein with a washer in a front inner end thereof, and said spray tube being coupled to said spray gun with said female threads of said spray tube threaded with said male threads of said spray gun, a circular gap being formed between said spray tube and said spray gun, said circular gap being interconnected with said circular recess of said spray gun, said collar being placed between said spray head and a front end of said spray gun and sealed by said nut thereat with said female threads of said nut threaded with said male threads of said spray gun, said outer ring of said spray head engaging with one end of said collar tight, whereas said slanting surface of said collar engaging with the front end of said spray gun, while said inner ring of said spray head engaging with said ring of said spray tube, a first chamber being formed between said inner ring of said spray head and said ring of said spray tube, said first chamber being interconnected with said spray hole of said spray head, and whereas a second chamber being formed between said outer ring of said spray head and said collar at front end of said spray gun.

* * * * *